United States Patent [19]

Bowermaster

[11] Patent Number: 4,506,903

[45] Date of Patent: Mar. 26, 1985

[54] WHEELCHAIR ATTACHMENT

[75] Inventor: Sidney P. Bowermaster, Carlisle, Pa.

[73] Assignee: NDK, Incorporated, Carlisle, Pa.

[21] Appl. No.: 471,476

[22] Filed: Mar. 3, 1983

[51] Int. Cl.[3] ..... A61G 5/02

[52] U.S. Cl. ..... 280/289 WC; 297/188; 297/DIG. 4

[58] Field of Search ..... 280/289 WC, 289 A, 289 R, 280/47.24, 32.7, 204, 401; 297/188, DIG. 4; 5/81 R

[56] References Cited

U.S. PATENT DOCUMENTS 3,970,344 7/1976 Baumann ..... 297/DIG. 4

4,305,601 12/1981 Berge ..... 280/289 WC 4,397,607 8/1983 Neill et al. ..... 280/401

*Primary Examiner*—John A. Pekar

*Attorney, Agent, or Firm*—Fidelman, Wolffe & Waldron

[57] ABSTRACT

A device is disclosed for detachably coupling a wheeled oxygen tank cart to a wheelchair such that they are transportable together as a unit without the need of a separate operator of the cart. The device is adjustable in length such that various sizes of wheelchairs may be accommodated. In one embodiment, the oxygen cart rolls in tandem with the wheelchair during use of the device; in another embodiment, the oxygen cart is wholly supported on the wheelchair by the device.

6 Claims, 11 Drawing Figures

73
72
76
4
3
2
60
71
50
66
62
64
70
68
63

Fig. 10
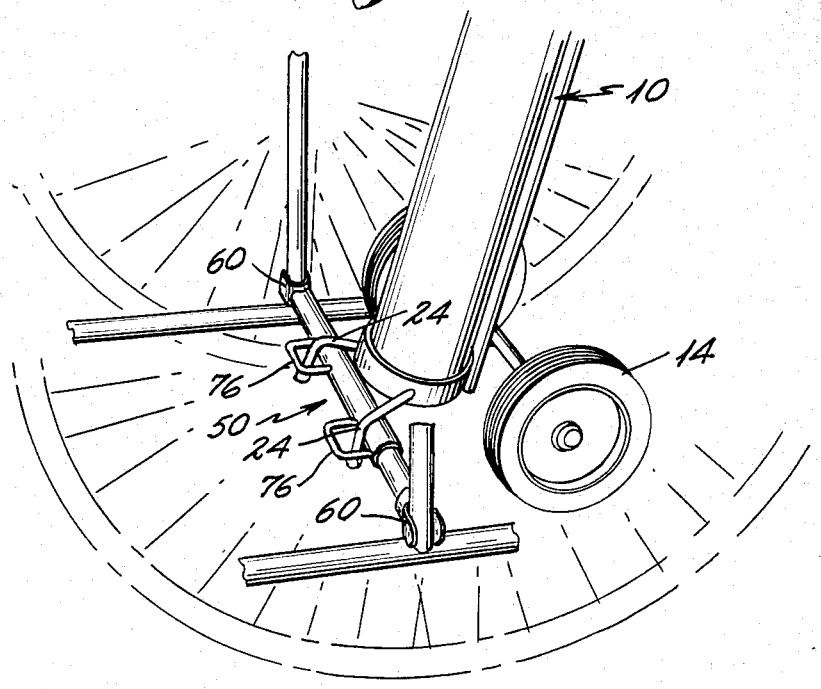
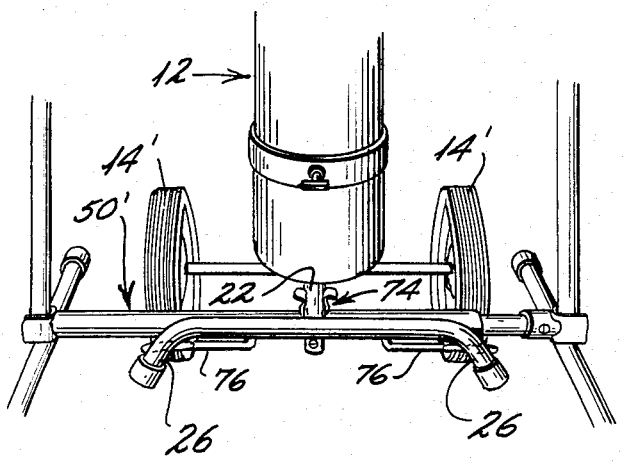
Fig. 11

WHEELCHAIR ATTACHMENT

BACKGROUND AND SUMMARY OF THE INVENTION

In the field of patient care, it is often necessary to transport a patient in a wheelchair or the like while the patient is connected to an oxygen tank. Some oxygen tanks are quite cumbersome and, accordingly, are mounted on wheeled carts specifically designed for transport of the tanks. When it is necessary to transport a patient while having oxygen readily available or while administering it to then from such tanks, an additional person is required for manipulating the cart and maintaining an oxygen line to the patient in the wheelchair. A nurse or attendant, while pushing the wheelchair, cannot also push the oxygen cart, necessitating the assignment of two persons to a patient to be transported—one to push the wheelchair and one to push the oxygen cart. Not only is there a need for two people instead of one in such an arrangement, but there is the increased danger of the oxygen line being disconnected since the two persons have to coordinate their efforts side-by-side so that there is no jerking or pulling of the oxygen line running between the cart-mounted bottle and the patient in the wheelchair.

It is known to provide a clamping device for direct attachment of an oxygen tank to a wheelchair or the like, but such devices do not provide for transport of the cart along with the wheelchair. In a hospital environment, it is often necessary to transport patients from one station, e.g., room or ward having a wall-mounted oxygen supply next to a bed, to another station of this type. Accordingly, it is only necessary to provide oxygen to the patient during transport between stations and, if a tank is clamped to the wheelchair, it must be removed from the standard cart prior to transport thereof and placed back in the cart after transport thereof or must be left attached to the wheelchair in order to be used for another patient. Obviously, not all patients need oxygen during transport, and it is uneconomical to have an oxygen tank attached to every wheelchair. Further, mounting of the larger oxygen tanks to wheelchairs often requires more than one person. Accordingly, it is normal practice to have an additional person to manipulate the oxygen tank cart, separate from and adjacent to the wheelchair, while maintaining an oxygen line to the patient. Further, there are some cases in which a patient, who is able to do limited propelling of the wheelchair in which he rides, requires oxygen or the ready availability thereof at all times.

What is needed is a device by which a tank-mounted cart may be detachably coupled to a wheelchair for transport therewith, without the need for an additional person to manipulate such a cart. Further, such a device should be easily attached and detached from the wheelchair for adaptation to different sizes and types of patient transport devices so that the attachment and detachment thereof may be accomplished by one individual, such as a nurse or an attendant. In this manner, economical use of such oxygen tanks and of the personnel necessary to care for the patient may be efficiently attained.

Accordingly, an object of the instant invention is to provide a device by which a wheeled oxygen tank cart may be detachably connected to the wheelchair so that no additional person is needed for manipulation of the cart during transport of a patient.

A further object of the invention is to provide an oxygen tank cart/wheelchair attachment device which is adjustable in nature, and will accommodate different carts and wheelchairs.

An additional object of the invention is to provide an attachment device for a wheelchair which will totally support such an oxygen cart, or will provide for a cart to move with the wheelchair, in tandem, during rolling support of the cart by its own wheels.

In one embodiment of the invention, a spring-biased telescoping tube is detachably coupled to base support members of a wheelchair and receives feet of a wheeled oxygen tank cart so that the cart is supported in a vertical direction by the cart wheels; and adjustable strap prevents rearward tipping of the cart. With such an arrangement, the cart is rollingly transportable in tandem with, and constrained by, the wheelchair and its attachment so that no additional person is necessary to manipulate the cart. By such an arrangement, either the patient or a person pushing the wheelchair may direct the wheelchair without having to worry about manipulation of the oxygen tank cart. In another embodiment, the weight of the cart and tank are totally supported by the wheelchair through use of the attachment device.

BRIEF DESCRIPTION OF THE DRAWINGS

FIG. 10 is a partial, isometric view of the arrangement of FIG. 9.

FIG. 11 is a partial, front plan view of the cart of FIG. 8 attached to a wheelchair by one embodiment of the invention, with the wheels of the cart resting on the surface of the floor.

DETAILED DESCRIPTION OF THE DRAWINGS

Figure 7:
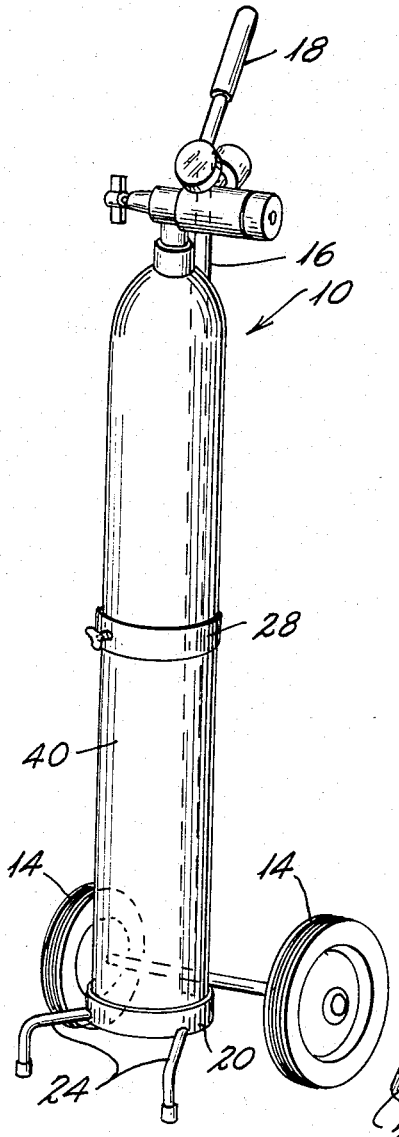
FIGS. 7 and 8 are isometrics of two different oxygen tank carts with which the invention is used.
Figure 8:
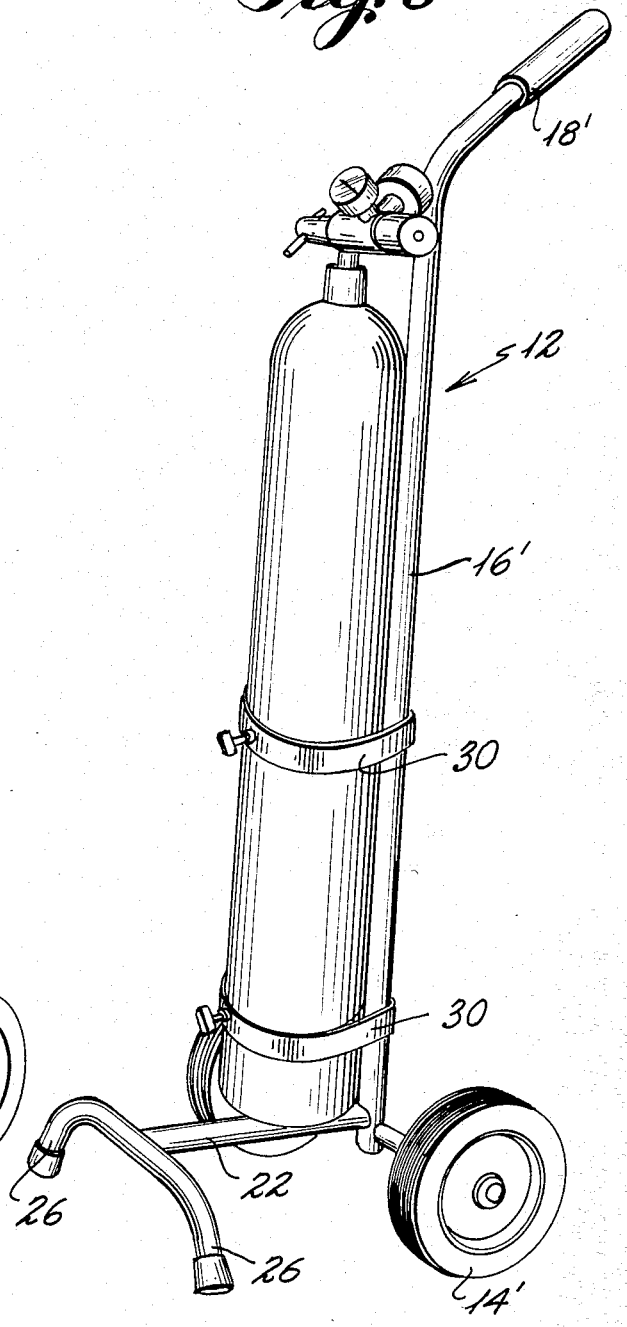

Two different versions of a wheeled oxygen tank cart are illustrated in FIGS. 7 and 8. In FIG. 7, feet 24 and wheels 14 provide stand-alone, stable support for a cart 10. With cart 10 (FIG. 7), base 20 provides vertical support for oxygen tank 40 which is clamped to a spine 16 by tank clamp 28. Spine 16 is extended and angled to provide handle 18 by which cart 10 may be tilted for transport of the oxygen tank in a well-known manner. FIG. 8 illustrates another cart 12 having a straight bar base member 22 and two tank clamps 30.

Figure 9:
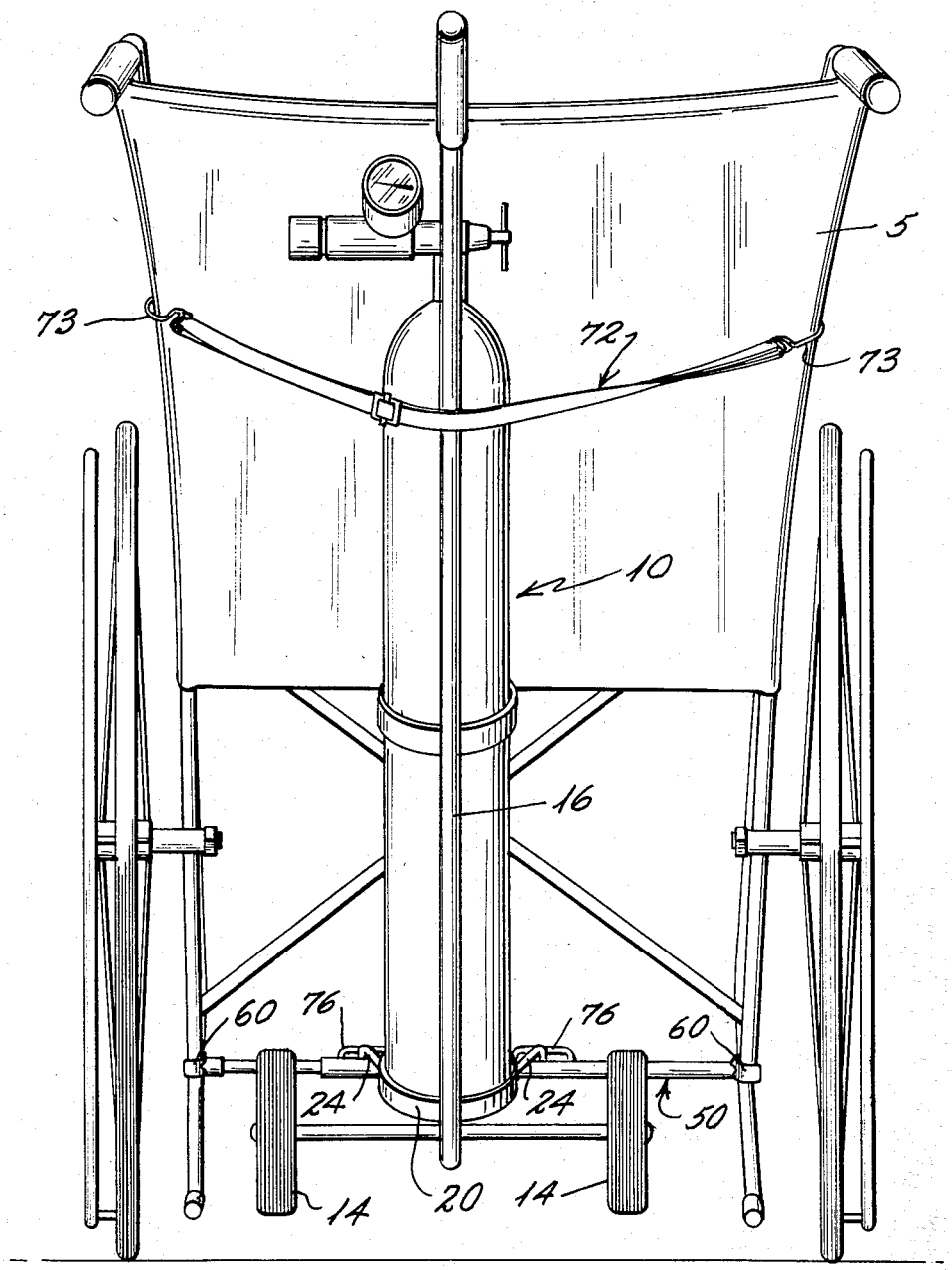
FIG. 9 is a rear plan view of the cart of FIG. 7 attached to a wheelchair by the novel attachment device, with the wheels of the cart supported off the surface of the floor.

FIG. 9 illustrates cart 10 fully supported by wheelchair 5 via the novel attachment device. Although not specifically illustrated in the drawings, it is also contemplated that the novel attachment device may be used with other vehicles, such as gerichairs and wheeled cots or stretchers commonly referred to as gurnies. The only requirement for such vehicles is that they have spaced horizontal or vertical rods, tubes, or the like between which the attachment device may span.

Having described those devices with which the novel attachment device is to be used, reference should also be had to FIGS. 1–6 for an understanding of the structure of the invention.

In a preferred embodiment (FIGS. 1–4), detachable spanner 50 comprises respective inner and outer telescoping tubes 62 and 66, each of which has a generally U-shaped member 60 for engagement with tubular base support members of a wheelchair (the manner of engagement may be seen in FIGS. 9–11). Other telescoping tube 66 has ears 76 affixed thereto, as by welding or the like, for reception of feet 24 of cart 10, such that cart 10 is transportable in the tilted position of FIGS. 9 and 10 while resting upon its wheels, or in the raised position of FIG. 11 (shown with cart 12) wherein it is totally supported by wheelchair 5. The attachment device also comprises an adjustable strap 72 having hook members 73 for engaging the upper portion of the wheelchair, as seen in FIG. 9, and preventing rearward tipping of cart 10.

Figures 1, 2, 3, 4:
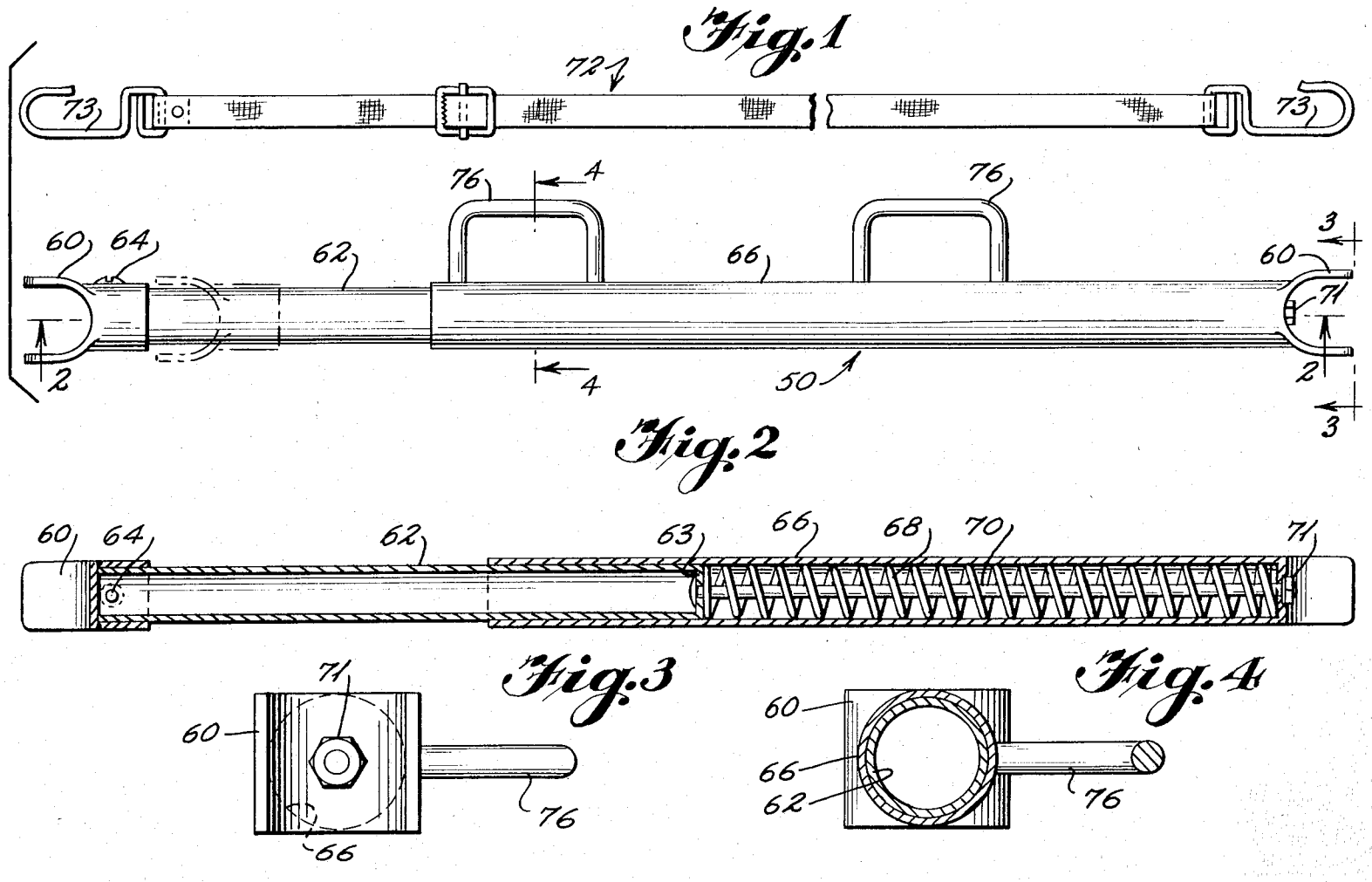
FIG. 1 is a top plan view of the main components of one embodiment of the wheelchair attachment device.
FIG. 2 is a cross-sectional view of one of the components of FIG. 1 as viewed, generally, along arrows 2—2 thereof.
FIG. 3 is an end elevation, viewed generally along arrows 3—3 of FIG. 1.
FIG. 4 is a cross-sectional, viewed generally along arrows 4—4 of FIG. 2.

Referring to FIG. 2, spring 68 biases tubular member 62 telescopingly outwardly from tubular member 66 by engagement with closed end 63. Tubes 62, 66 are retained in telescoping cooperation by threaded rod 70 which passes through a hole in end 63 of tube 62 and along the axis of spring 68 and is received by nut 71.

Figure 5:
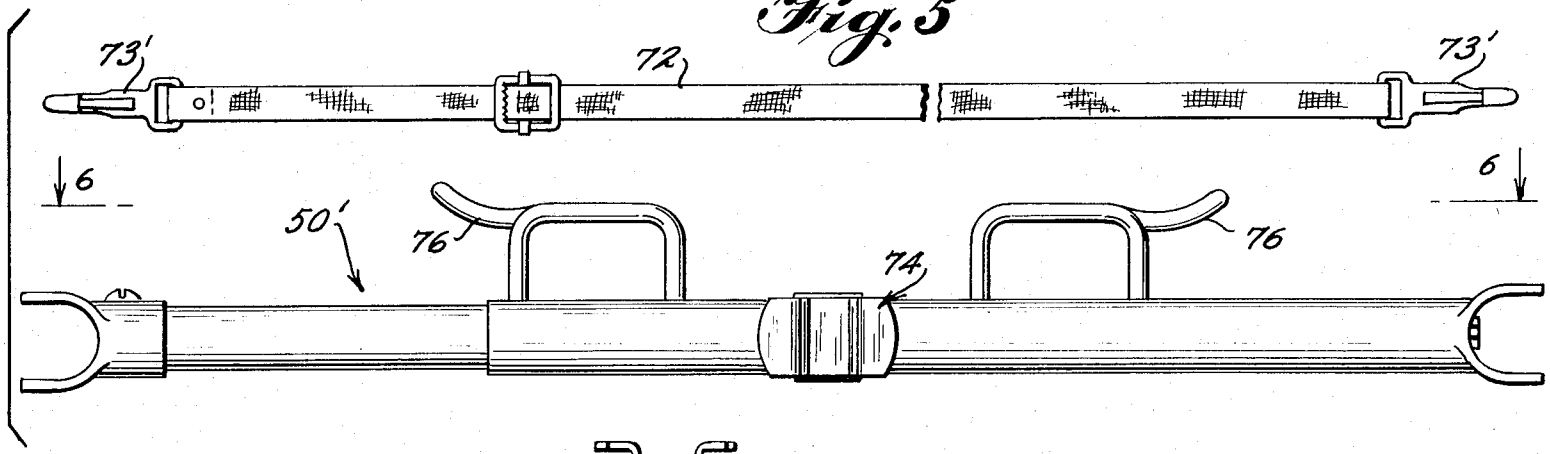
FIG. 5 is a top plan view of an alternate embodiment of the invention.
Figure 6:
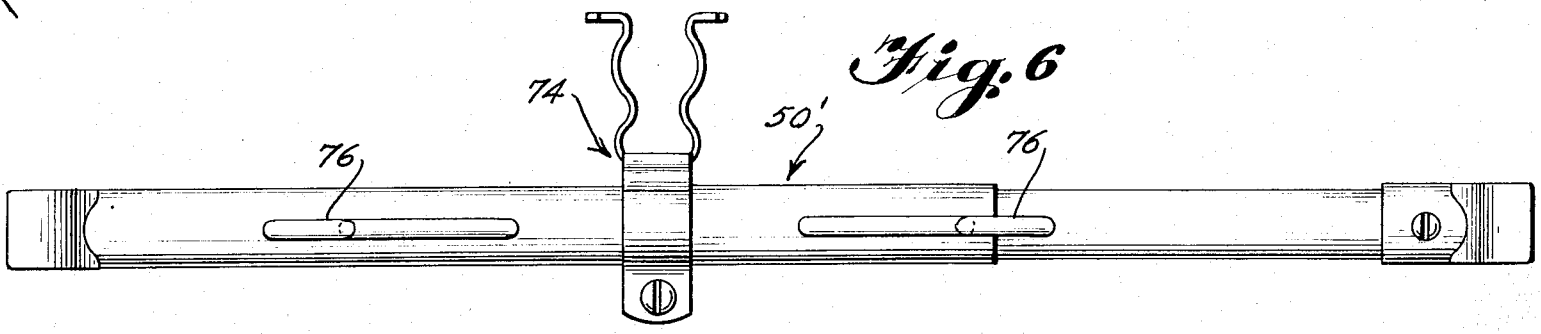
FIG. 6 is a side elevation of one of the components of FIG. 5, as viewed generally along arrows 6—6 thereof.

Referring to FIGS. 5 and 6, spanner bar 50' includes the additional features of ears 76 and spring metal clip 74 in order to better accommodate cart 12 of FIG. 8. In this regard, spring clip 74 engages with base member 22 of cart 12.

In the context of the invention, other means are contemplated, but not shown, for adjustment of spanner bar 50. For instance, a set screw arrangement, a turnbuckle arrangement, or a turnbuckle/spring arrangement may be used for such adjustment. It is also contemplated that spanner portion 50 of the attachment device may be permanently affixed to the wheelchair or the like in a well-known manner.

Having described the invention, it will thus be seen that the objects set forth above, among those made apparent from the preceding description, are efficiently attained and, since certain changes may be made in carrying out the above method and in the construction set forth without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed as new and desired to be secured by Letters Patent is:

1. A wheelchair attachment device comprising:

means for detachably coupling a wheeled oxygen tank cart in tandem with said wheelchair such that said cart is stabilized fore and aft by said wheelchair and supportable vertically by wheels of said cart, said coupling means comprising means for spanning and attaching to horizontally spaced structural members near a base of said wheelchair for supporting and limiting forward movement of said cart, said coupling means further comprising means for attaching said cart to a portion of said wheelchair above said base and limiting rearward tipping of said cart, such that said wheelchair and said cart are rollingly transportable as a unit when coupled.

2. A device as in claim 1, wherein said spanning means further comprises:

means for adjusting a length thereof such that different spans are accommodated.

3. A device as in claim 2, wherein said adjusting means comprises:

spring biased telescoping of said spanning means.

4. A wheelchair attachment device for attaching an oxygen tank cart thereto, said oxygen tank cart including wheels and at least one foot and being self-supportable in a generally vertical orientation by engagement of said at least one foot and said wheels with a horizontal surface comprising:

means for detachably coupling said wheeled oxygen tank cart in tandem with said wheelchair such that said cart is stabilized fore and aft by said wheelchair and supportable vertically by wheels of said cart, said coupling means comprising means for spanning and attaching to horizontally spaced structural members near a base of said wheelchair, said means for spanning said cart including means to limit forward movement of said cart, said spanning means including means mounted on said spanning means for engaging said foot and limiting sideways shifting of said cart relative to said wheelchair when attached.

5. A device as in claim 4, wherein said cart comprises plural feet and said engaging means receives at least one of said feet for limiting said shifting.

6. A device as in claim 5, wherein said coupling means is adjustable on said base of said wheel chair whereby wheels of said cart can be supported at varying levels.

* * * * *